US005197386A

United States Patent [19]

Lin

[11] Patent Number: 5,197,386

[45] Date of Patent: Mar. 30, 1993

[54] HAND-HELD TYPE PACKAGING TAPE DISPENSER WITH PRINTING MECHANISM

[76] Inventor: Sherman Lin, P.O. Box 3-81 Yung Ho, Taipei Hsien, Taiwan

[21] Appl. No.: 866,502

[22] Filed: Apr. 10, 1992

[51] Int. Cl.[5] ..... B41F 17/06

[52] U.S. Cl. ..... 101/213; 156/579

[58] Field of Search ..... 101/213, 226; 225/56, 225/65, 66, 70, 71, 72, 91, 92, 88; 156/576, 577, 579, 250, 523

[56] References Cited

U.S. PATENT DOCUMENTS

| | | | |
|---|---|---|---|
| 2,223,907 | 12/1940 | Bronfman | 101/226 |
| 2,323,976 | 7/1943 | Chalmers | 101/216 |
| 3,785,901 | 1/1974 | Fritzinger | 156/579 |
| 4,762,586 | 8/1988 | Wilkie | 275/39 |
| 4,947,747 | 8/1990 | Hermann | 101/320 |
| 5,073,228 | 12/1991 | Lin | 225/72 |

*Primary Examiner*—Edgar S. Burr
*Assistant Examiner*—Lynn D. Hendrickson
*Attorney, Agent, or Firm*—Morton J. Rosenberg; David I. Klein

[57] ABSTRACT

A hand-held packaging tape dispenser is provided which includes a rotary tape holder controlled by a spring mechanism and an adjusting nut for holding and guiding packaging tape. The packaging tape guide roller provides for a guide for the leading end of the packaging tape. A cutting mechanism includes a pressure plate, a cutter holder, and a swing block which are controlled by a spring for cutting off the leading end of the packaging tape delivered from the housing. A printing mechanism prints on the leading end of the packaging tape and a packaging tape stretching mechanism stretches the leading end of the packaging tape for a printing operation by the printing mechanism.

1 Claim, 5 Drawing Sheets

HAND-HELD TYPE PACKAGING TAPE DISPENSER WITH PRINTING MECHANISM

BACKGROUND OF THE INVENTION

1. Field of the Invention

The present invention relates to tape dispensers. More particularly, the present invention relates to hand-held type packaging tape dispensers for use in taping containers, packages or other items during a taping procedure.

2. Prior Art

One type of prior art hand-held dispenser is shown in FIG. 1. This prior art type system provides a casing A which is supported on a handle F to hold a socket B and a roller G for mounting as well as guiding packaging tape C. A toothed cutter H and a pressure plate E is disposed above the roller G for cutting and pressing down on the leading end D of the packaging tape C. This type of hand-held dispenser structure is not generally considered satisfactory in use due to the following disadvantages:

(1) the toothed cutter is fixedly located in a position which faces the user's hand and may injure the operator during a packing operation;

(2) the toothed cutter and the pressure plate are not enclosed for protection purposes and therefore may be damaged during use or when stored;

(3) the leading end of the packaging tape is exposed to the external environment and may be contaminated with dust, causing a resultant loss in its adhesive strength; and, (4) the cutting operation is difficult to control due to the fact that a large force must be applied to the toothed cutter during a cutting operation.

SUMMARY OF THE INVENTION

It is an object of the present invention concept to provide a hand-held type packaging tape dispenser which is simple to operate and practical for use by an operator.

It is another object of the present invention to provide a hand-held type packaging tape dispenser which has a mechanism to protect the leading end of the packaging tape held therein.

It is still another object of the present invention to provide a hand-held type packaging tape dispenser which has a printing mechanism for printing the packaging tape which is dispensed.

According to the present invention, there is provided a hand-held type packaging tape dispenser which includes a rotary tape holder controlled by a spring mechanism and an adjusting nut for holding and releasing packaging tape. A packaging tape guide roller for guiding the leading edge of the packaging tape, as well as a cutting mechanism formed by a pressure plate, are provided. A cutter holder and a swing block controlled by the spring mechanism moves into and out of holes formed in a housing for cutting off the leading end of the packaging tape. A printing mechanism for printing the leading end of the packaging tape, and a packaging tape stretching mechanism to stretch the leading end of the packaging tape for printing by the printing mechanism provides increased printing efficiency. The printing mechanism includes a printing-plate cylinder controlled by a spring mechanism which contacts the leading end of the packaging tape for printing. An ink roller supported by the spring mechanism closely contacts the printing-plate cylinder and an ink fountain distributes printing ink through the ink roller. The packaging tape stretching mechanism includes a push board forced by a spring mechanism to press on the leading end of the packaging tape on one side thereof and a guide post to support the leading end of the packaging tape at an opposite side thereof to provide a smooth and continuous printing operation.

DESCRIPTION OF THE PREFERRED EMBODIMENTS

Figure 1:
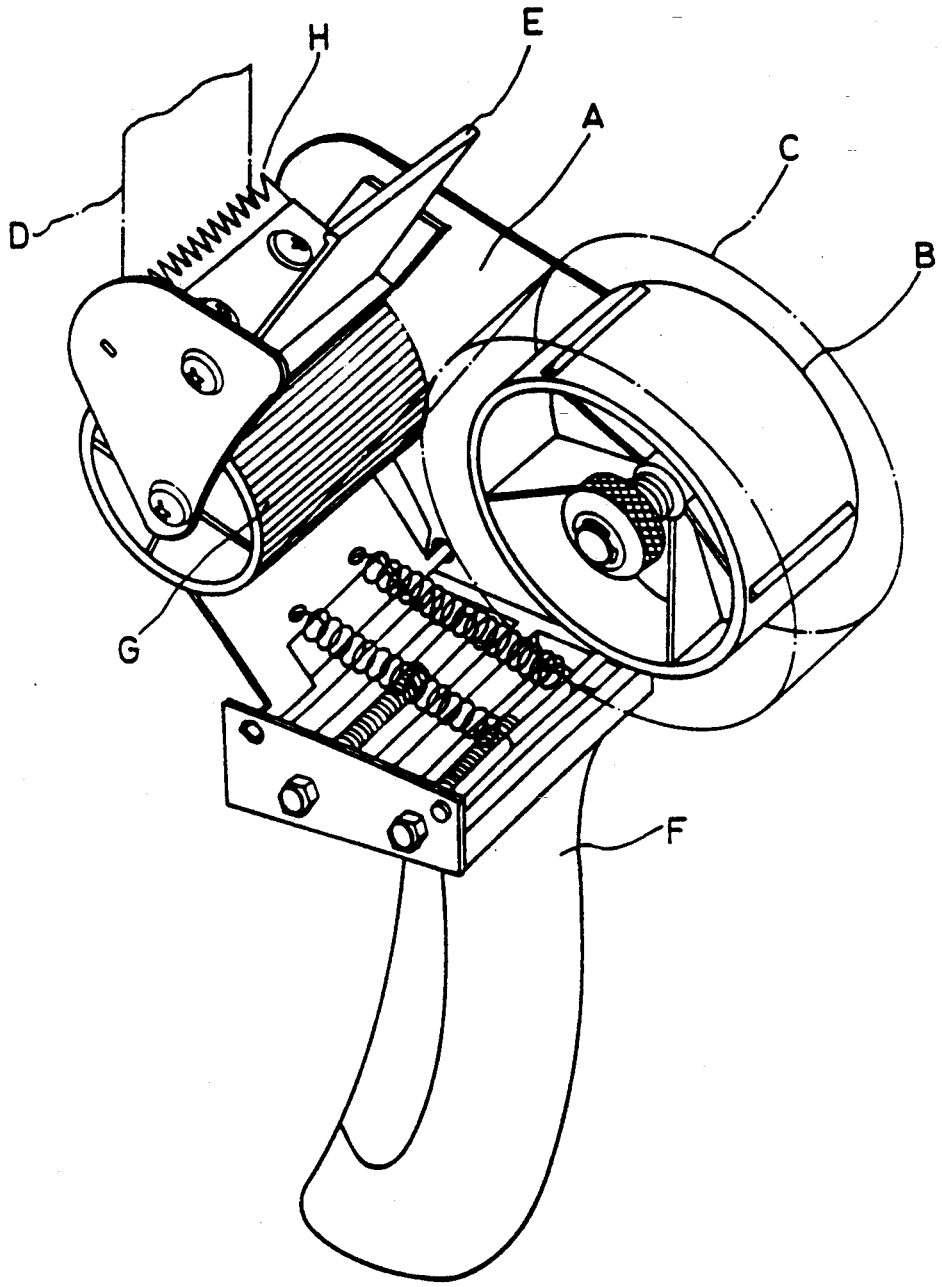
F I G. 1 (PRIOR ART)
FIG. 1 is a perspective view of a hand-held type packaging tape dispenser according to the prior art.
Figure 2:
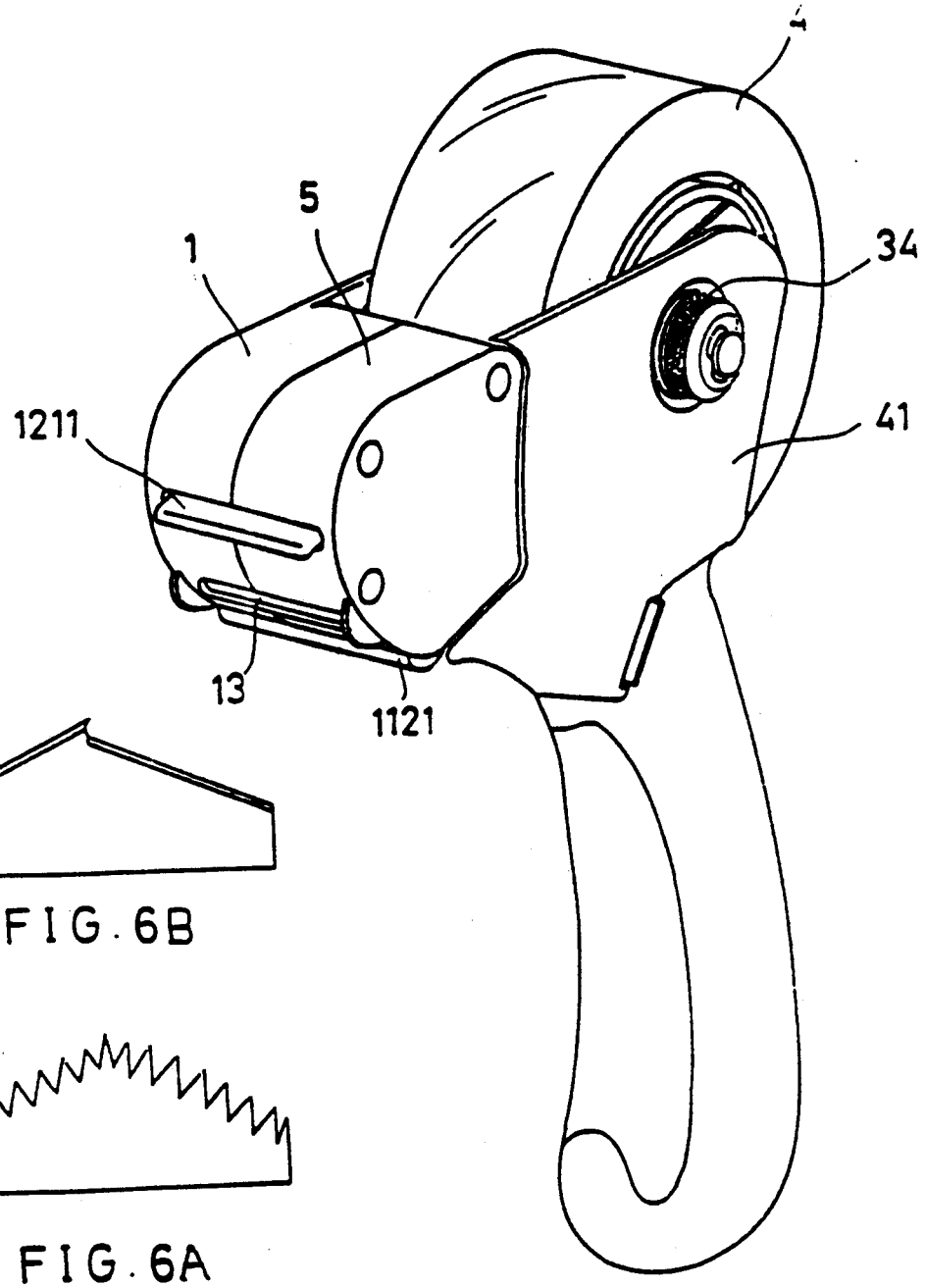
FIG. 2 is a perspective view of the preferred embodiment of the hand-held packaging tape dispenser of the present invention.
Figure 6B:
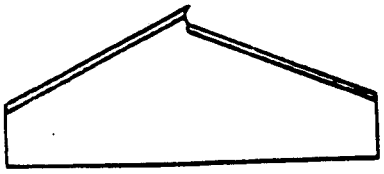
Figure 6A:
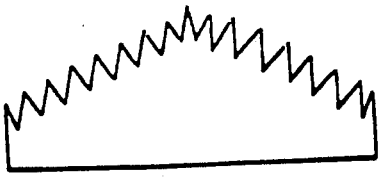
Figure 6:
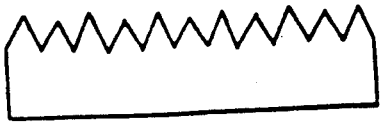
Figure 3:
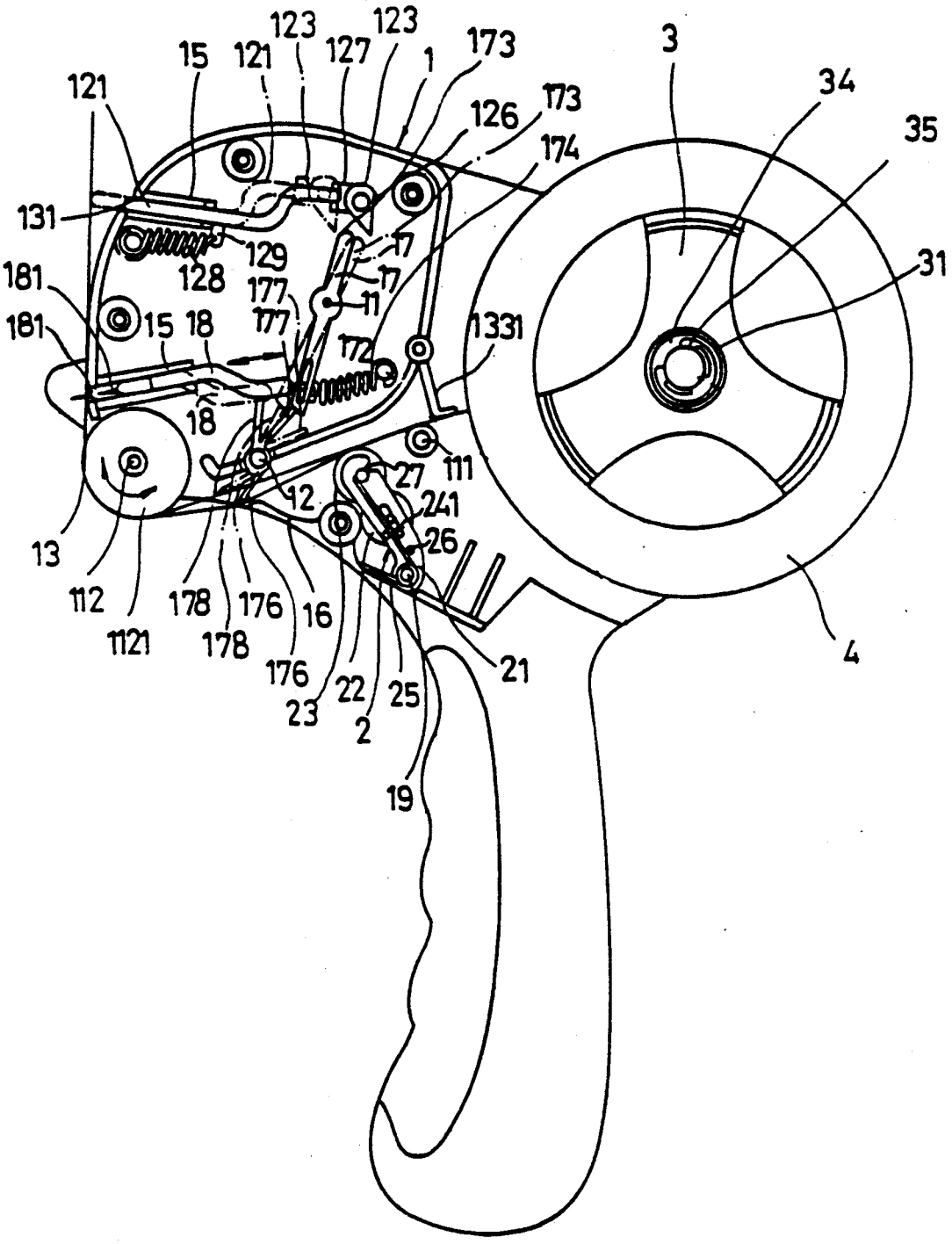
FIG. 3 is an elevated view, partially cut-away, of the hand-held type packaging tape dispenser of FIG. 2 showing its internal structure.
Figure 4:
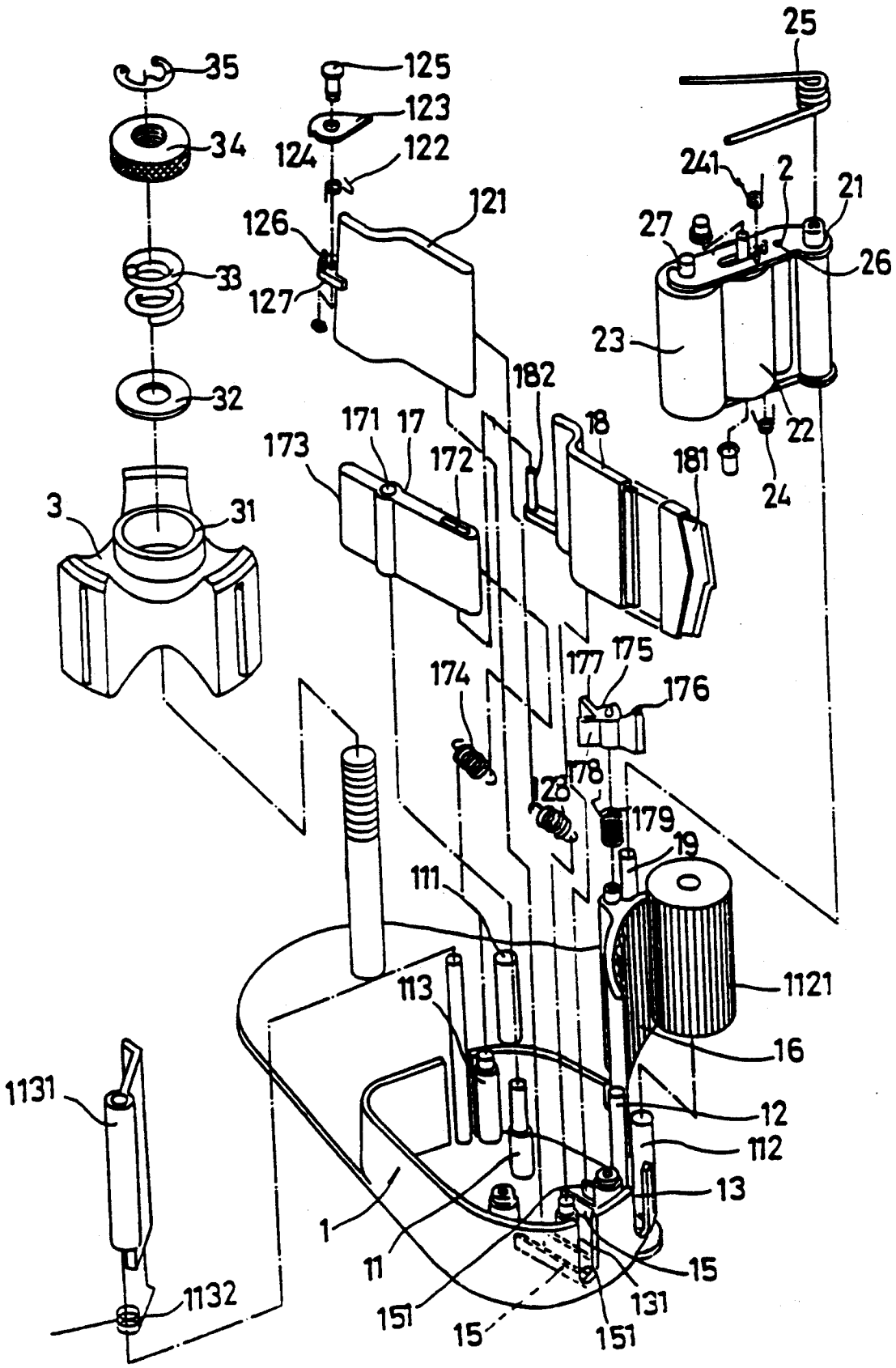
FIG. 4 is an exploded view of the hand-held packaging tape dispenser of FIG. 2.

Referring to FIGS. 2, 3 and 4, a pressure plate 121, a swing block 17, and a cutter holder 18 form a cutting mechanism which is fastened to and located internal housing 1 within a frontal end thereof. The cutting mechanism is enclosed by a cover 5 and the cutter holder 18 has a cutter blade 181 mounted thereon. As shown in FIGS. 2 and 3, a cutter blade outlet hole 13 and pressure plate outlet hole 131 are formed through housing 1 and cover 5. In this manner, cutter blade 181 and the pressure plate 121 may be extended and retracted through openings or holes 13 and 131. Ribs 15 are formed internal housing 1 defining two guideways or sliding ways 151 aligned with the outlet holes 13, 131 for displacing the cutter blade 181 and the pressure plate 121. Swing block 17 has an axle hole 171 mounted on a post 11 inside the housing 1 to allow rotational displacement. A push hole 172 is provided for inserting side posts 182 of the cutter holder 18. Therefore, rotation of the swing block 17 on the post 11 causes the cutter holder 18 to be alternatively and reversibly displaced. The pressure plate 121 has a lug 127 formed on one side for holding push plate 123 through a fastening element 125 and a spring 122. The push plate 123 has a notch 124 formed in the peripheral edge thereof terminated by a pin 126 on the lug 127. In this manner, the push plate 123 is confined to alternatively rotate back and forth within a fixed pathway. Under normal operation conditions, the pressure plate projects out of the pressure plate outlet hole 131. When the pressure plate 121 is forced against a carbon box during a packing operation, it is displaced internal the housing 1, which causes the push plate 123 to force load the swing block 17. When the swing block 17 is rotated in one direction by the push plate 123, the cutter holder 18 is simultaneously rotated to extend the cutter blade 181 through the cutter blade outlet hole 13. Once the cutter blade 181 is passed through the cutter blade outlet hole 13, the packaging tape 4 is cut off at a desired length. The shape of the cutter blade 181 may be variously embodied and such is shown in FIG. 6, which illustrates various alternate forms of cutter blade contours according to the present invention concept. When the cutter blade 181 has been extended through the cutter blade outlet hole 13 in cutting off the packaging tape 4, the opposite end edge 173 of the swing block 17 is displaced away from the push plate 123 of the pressure plate 121. Immediately thereafter, the swing block 17 is forced by a spring 174 to move back to its original position which causes the cutter holder 18 to be reversibly displaced and therefore, the pressure plate 121 is moved back to its original position by spring 128. At the same time, the push plate 123 is moved by the spring 122 over the opposite end edge 173 of the swing block 17 and returned to its original position. There is provided a stop member 175 mounted on a post 12 inside the housing 1. The stop member 175 is comprised of three wings, namely, the first wing 176, the second wing 177, and the third wing 178, which is supported on post 12 by a spring 179. The first wing 176 is abutted by a guide plate 16. The second wing 177 abuts the swing block 17 at the bottom and thus, the cutter holder 18 is held within the housing 1. When the packaging tape 4 is pulled, the first wing 176 of the stop member 175 is rotated inward, causing the second wing 177 to disconnect from the swing block 17, and therefore, the swing block 17 is released from the stop member 175 to allow the cutting operation. When the swing block 17 has been displaced to its limit displacement, the third wing 178 of the stop member 175 is simultaneously rotated, causing the second wing 177 to move back to its original position abutting the swing block 17. The packaging tape 4 is mounted on a seat 31 of a rotary tape holder 3 which is secured to the housing 1 at the back of the cutting mechanism by a washer 32, a spring mechanism 33, an adjusting nut 34, and a clamp 35. A roller 1121 is mounted on a post 112 internal the housing 1 for holding the leading end of the packaging tape 4. There is provided a printing mechanism 2 mounted on a post 19 in the tape dispensing path between the tape holder 3 and the roller 1121 for printing the packaging tape 4. The printing mechanism 2 is comprised of a frame 21 to hold a printing-plate cylinder 23 and an ink roller 22. A notch 27 is formed on the frame 21 so that replacing the printing-plate cylinder 23 is easily accomplished. The ink roller 22 is supported by springs 24, 241 at opposite ends thereof to be constantly flexibly and contiguous the printing-plate cylinder 23. There is provided a spring 25 to support the frame 21, permitting the printing-plate cylinder 23 to be maintained in contact with the surface of the packaging tape 4. A push plate 1131 is supported on the post 1121 and controlled by a return spring 1132 to press the leading end of the packaging tape 4 against a guide post 111 for printing.

Figure 5:
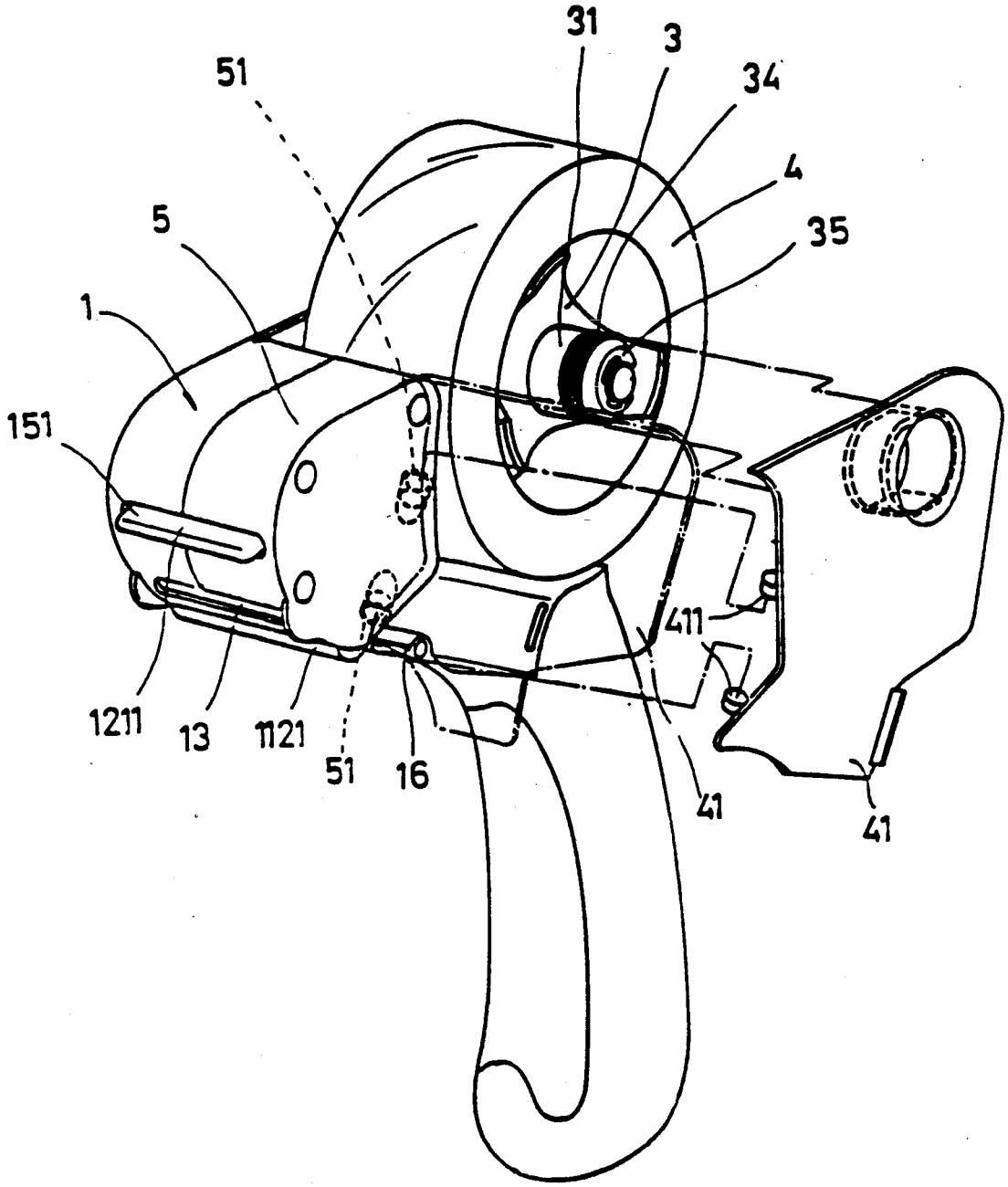
FIG. 5 is a perspective, partially blow-out view of the hand-held type packaging tape dispenser of FIG. 2 showing that the side guard has been removed from the cover; and, FIGS. 6, 6A and 6B illustrate various alternate forms of the cutter blades according to the present invention concept.

Referring to FIG. 5, a side guard 41 is secured to the cover 5 and partly covers the rotary tape holder 3 to protect the packaging tape 4 and firmly secure it in place. The side guard 41 has two opposing hooks 411 releasably hooked in two retaining holes 51 on the cover 5. In this manner, the side guard 41 can be simply detached from the cover 5 to replace a packaging tape.

I claim:

1. A hand-held packaging tape dispenser, the improvement comprising:

(a) a rotary tape holder having packaging tape, a post, a housing, spring means, and an adjusting nut, said rotary tape holder being mounted on said post at one end of said housing and revolvably secured by said spring means and said adjusting nut for holding and letting off said packaging tape;

(b) a packaging tape guide roller for guiding a leading end of said packaging tape external said housing;

(c) a cutting mechanism fastened in said housing being located in front of said rotary tape holder and being controlled to selectively cut a leading end of said packaging tape being delivered out of said housing, said cutting mechanism having a pressure plate, spring means, a pressure plate outlet hole, a cutter holder, a cutter blade, a swing block, and a cutter blade outlet hole, said pressure plate being controlled by said spring means of said cutting mechanism and extending out of said pressure plate outlet hole, said swing block being rotated by said pressure plate and moving said cutter blade out of said cutter blade outlet hole for cutting off said packaging tape, said pressure plate outlet hole and said cutter blade outlet hole having sliding ways respectively disposed in line with said outlet holes for moving said cutter holder and said pressure plate, said cutter holder having a side post linked to said swing block, said pressure plate having a lug, a swinging push plate, a fastening element, and a return spring, said lug holding said swinging push plate to one side by said fastening element and said return spring, said swinging push plate having a notch, a peripheral edge and a pin, with said notch located on said peripheral edge and stopped by said pin located on said lug, said swinging push plate moving said pressure plate into said pressure plate outlet hole and moving said cutter blade out of said cutter blade outlet hole via said swing block, said pressure plate being released and causing said cutter holder to move said cutter blade back into said cutter blade outlet hole; and, (d) a printing mechanism for printing on said packaging tape, said printing mechanism comprising a printing plate cylinder, spring means, an ink roller, an ink fountain having printing ink therein, said printing plate cylinder being controlled by said spring means of said printing mechanism to hold the printing plate cylinder in contact with said packaging tape while printing, said ink roller being supported by said spring means of said printing mechanism to hold the ink roller in contact with said printing plate cylinder, said ink fountain distributing printing ink to said ink roller.

* * * * *